United States Patent [19]

Harbaugh

[11] Patent Number: 4,615,802

[45] Date of Patent: Oct. 7, 1986

[54] POOL VACUUM CLEANING SYSTEM

[76] Inventor: Theodore L. Harbaugh, 8878 Moorcroft Ave., Canoga Park, Calif. 91304

[21] Appl. No.: 666,776

[22] Filed: Oct. 31, 1984

[51] Int. Cl.[4] ..... E04H 3/16; E04H 3/20

[52] U.S. Cl. ..... 210/169; 210/416.2; 15/1.7; 285/271

[58] Field of Search ..... 210/169, 416.1, 416.2, 210/513, 523, 525, 803; 15/1.7; 285/175, 261, 271

[56] References Cited

U.S. PATENT DOCUMENTS

| | | | |
|---|---|---|---|
| 2,151,833 | 3/1939 | Bugatti | 285/271 |
| 3,229,315 | 1/1966 | Watson | 15/1.7 |
| 3,868,739 | 4/1975 | Hargrave | 210/169 |
| 3,972,339 | 8/1976 | Henkin et al. | 15/1.7 |
| 4,240,174 | 12/1980 | Thiem et al. | 210/169 |
| 4,401,576 | 8/1983 | Meurer | 210/803 |

*Primary Examiner*—Richard V. Fisher
*Assistant Examiner*—Sharon T. Cohen
*Attorney, Agent, or Firm*—John J. Posta, Jr.

[57] ABSTRACT

The improved system includes a poolside vacuum-generating machine having a vacuum-generating power source, filter, waste disposal means and a passageway through the casing; a lead weighted vacuum head which may be flexible and is adapted to sit on a pool bottom, and includes a stem defining a vertical suction passageway therethrough; a flexible conduit connected at its upper end to the machine; and, a universal ball joint connector connected to the lower end of the flexible conduit and to the vacuum head stem, so as to permit universal rotation of the head for better pool bottom cleaning. The connector includes a ball joint component with central vertical passageway, an upper cup-shaped conduit-receiving end and a lower end with rounded outer surface, and a sleeve the upper end of which bears a curved annular insert bearing against and holding the ball joint components rounded outer surface in place. The lower end of the sleeve is secured to the vacuum head stem. The system is inexpensive, durable and highly effective in reaching out-of-the-way pool bottom corners and the like.

18 Claims, 4 Drawing Figures

POOL VACUUM CLEANING SYSTEM

BACKGROUND OF THE INVENTION

1. Field of the Invention

The present invention generally relates to cleaning means and, more particularly, to a pool bottom cleaner of an improved type.

2. Prior Art

Pool cleaning machines usually are either of the floating type or pool bottom type. The floating type skims across the surface of the pool water, removing debris which has just fallen into the water and has not settled to the bottom. The pool bottom type includes a flexible vacuum conduit connected at one end to a source of suction, such as inlet pipe of a pool pump located at the pool skimmer or to poolside machine. The other end of the conduit is connected to the fixed upright stem of a weighted vacuum head. The head is adapted to be pushed or dragged along the pool bottom by a long pole releasably secured to the head. However, since the head usually has a relatively broad flat bottom to enable it to cover a reasonable amount of area, it is difficult to maneuver over the curved surfaces of the pool bottom and those portions where the pool sides meet the pool bottom, the very areas where much debris accumulates. Certain newer pool bottom cleaning devices have the vacuum head connected to the flexible conduit so that the head can swivel on a single plane.

However, there still is a need for further improvements in pool bottom cleaning apparatus which will improve the flexability, speed and efficiency with which all portions of the pool bottom can be vacuumed free of debris.

SUMMARY OF THE INVENTION

The improved pool bottom vacuum cleaning system of the present invention satisfies all the foregoing needs. The system is substantially as set forth in the Abstract above. Thus, the system includes a vacuum-generating poolside machine connected to a pool bottom, weighted vacuum head by a flexible conduit. Moreover, a universal ball joint connector is interposed between the top stem of the vacuum head and the lower end of the conduit, imparting the capability of moving the vacuum head in all directions and planes so as to more efficiently pick up debris scattered on the pool floor, in pool corners, along the pool walls and in curved surface areas, etc.

The ball joint connector comprises a ball joint component, the upper end of which connects to the lower end of the flexible conduit, while the lower end of which component comprises a ball joint having a curved or rounded outer surface. The connector also includes a sleeve, the upper end of which is connected to the described curved outer ball surface by an annular insert retainer and the lower end of which is connected to the vacuum head stem. Sufficient clearance of components permits free rotation of the vacuum head, stem and sleeve in all directions and at all angles. The vacuum head can be made sufficiently small and flexible to facilitate maintaining contact and suction in a curved surface area, such as pool bottom corners.

Further features of the invention are set forth in the following detailed description and accompanying drawings.

DRAWINGS

DETAILED DESCRIPTION

Figure 1:
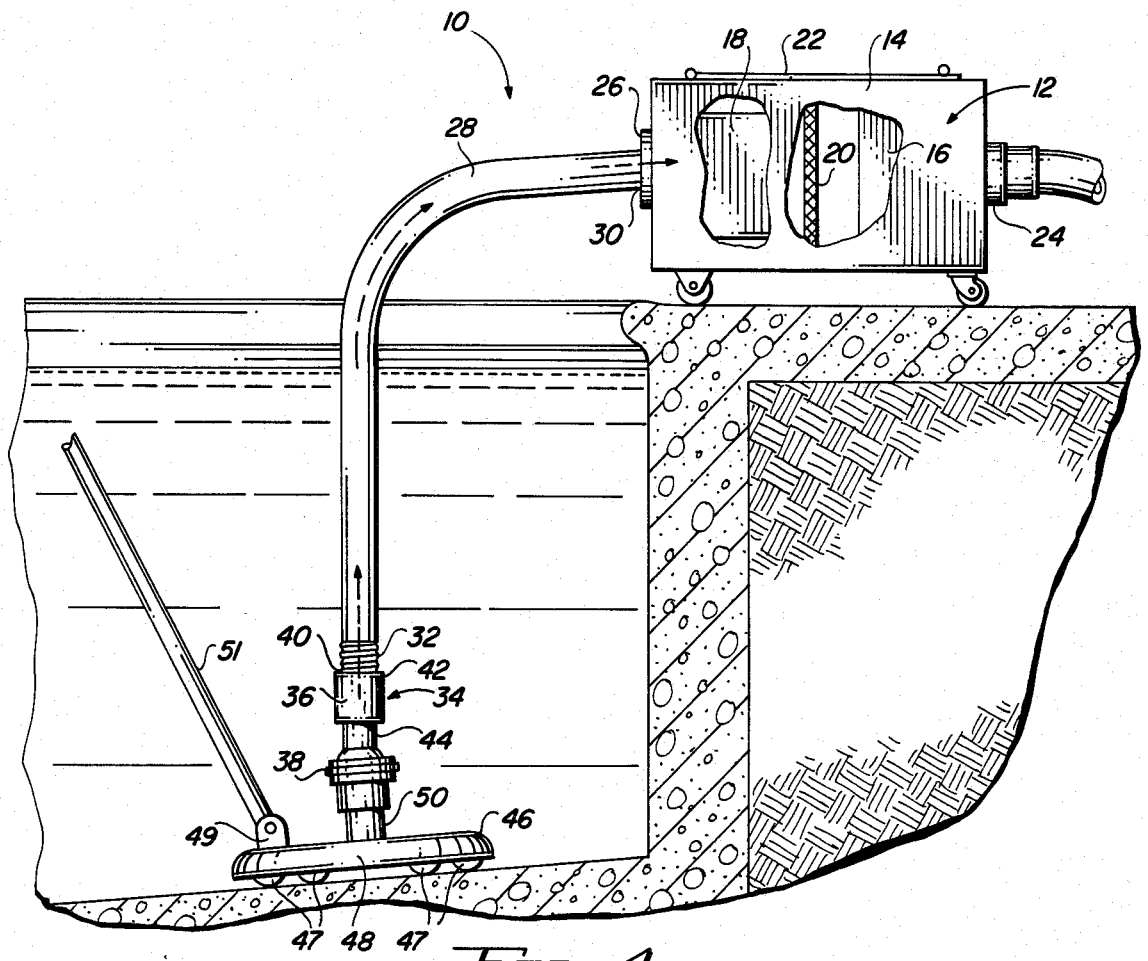
FIG. 1 is a schematic, fragmentary side elevation, partly broken away and partly in suction, illustrating a preferred embodiment of the improved pool bottom vacuum cleaning system of the present invention.
Figure 2:
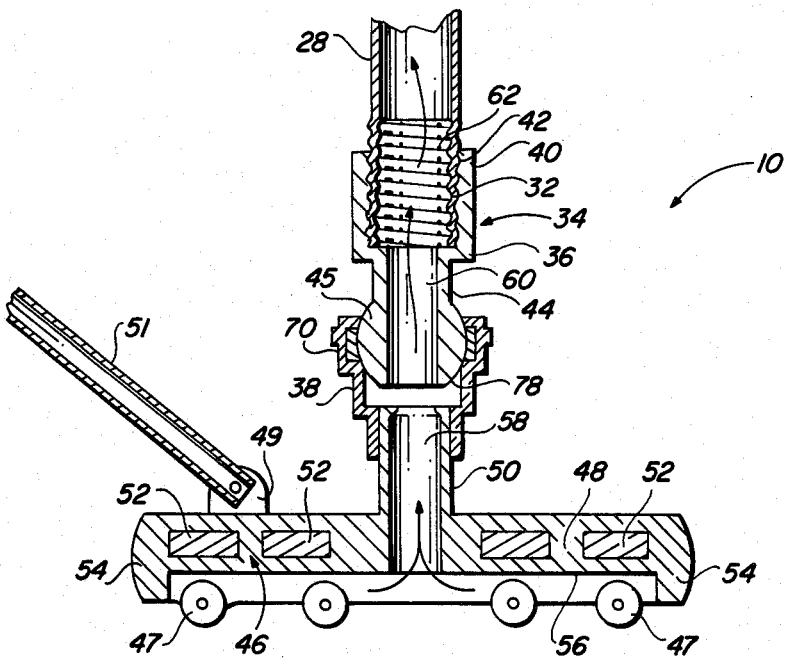
FIG. 2 is an enlarged schematic vertical cross section of the vacuum head, ball joint connector and flexible conduit portions of the improved system of FIG. 1.
Figure 3:
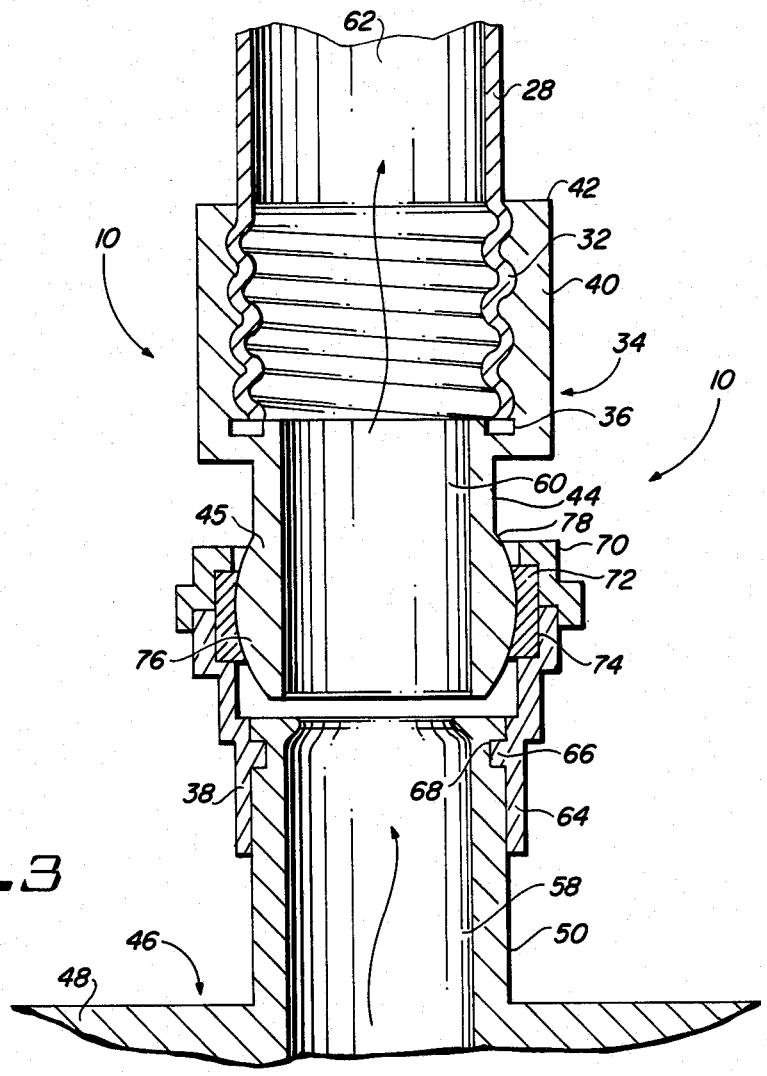
FIG. 3 is a further enlarged, fragmentary vertical cross section of the ball joint connector of the device of FIG. 1; and, FIG. 4 is an enlarged, fragmentary side elevation, partly broken away and partly in section, of a modified form of the improved ball joint component of the connector of the present invention.

FIGS. 1, 2 and 3

Now referring more particularly to FIG. 1 of the accompanying drawings, a preferred embodiment of the improved pool bottom vacuum cleaning system of the present invention is schematically depicted therein. Thus, system 10 is shown, which includes a machine 12 having a casing 14 containing a vacuum-generating power source such as a gasoline engine, or electrical motor connected to an internal passageway 18 extending lengthwise through casing 14. Machine 12 also may have a filter 20 in passageway 18, a trap door 22 with access thereto, and an outlet 24 for waste disposal and an inlet 26 connected to passageway 18.

As shown more particularly in FIGS. 2 and 3, system 10 includes a flexible tubular conduit 28 connected at its upper end 30 to inlet 26 and at its lower end 32 to a ball joint connector 34. Connector 34 comprises a ball joint component 36 and an outer sleeve 38. Component 36 has a cup-like receptacle 40 at its upper end 42 connected by a narrow central neck 44 to a lower ball shaped portion 45 having a rounded outer surface 78. It will be noted that the outer surface of the lower end 32 and the inner surface of cup 40 are threaded so that end 32 is threadably received in cup 40.

System 10 further includes a vacuum head 46 comprising a flat, horizontal disc-shaped portion 48 and a central vertical stem 50. Disc 48 contains a plurality of spaced lead, iron, or other heavy weights 52 and a depending periphery 54 defining a central bottom suction space 56. Space 56 communicates with a central passageway 58 in stem 50 which is in turn aligned with a central passageway 60 in connector 34 and central passageway 62 in conduit 28.

Disc 48 also has a plurality of wheels 47 pivotally secured to its underside. The top of head 48 carries raised retainer 49 which is adapted to pivotally and removably receive along pole 51 for maneuvering the head 46 about the pool bottom.

The lower portion 64 of sleeve 38 of connector 34 fits over stem 50 and is connected thereto by an inwardly directly detent 66 seated in a groove 68 in the outer surface of stem 50. The upper portion 70 is expanded to receive an annular insert 72 in a pocket or recess 74 therein. The inner surface 76 of insert 72 is smooth and curved to match that of the outer curved surface 78 of component 36 and bears thereagainst to hold component 36 in place in sleeve 38 against withdrawal therefrom while permitting component 36 to freely rotate and pivot in all directions. In this regard, the upper end of sleeve 38 is spaced below neck 44 to assure that such rotation and pivoting can occur without interference and contact between sleeve 38 and cup 40 of component 36.

Thus, head 46 is firmly interconnected to conduit 28 but free to move in all directions relative thereto for maximum efficiency in pool bottom suctioning up of debris through head 46, connector 34 and conduit 28 and into and out of machine 12, due to the suction or vacuum exerted thereby through the described aligned passageways 18, 58, 60 and 62.

It can be appreciated that wear will primarily occur between the portion 45 and insert 72, the design disclosed enables easy replacement of insert 45 when excessively worn.

It will be understood that system 10 works equally well to suction off debris built up on the pool sides, as well as the pool bottom. Moreover, head 46, specifically disc 48, can be made sufficiently flexible so that it can conform to pool bottom irregularities, curves and corners while still exerting efficient suctioning for removing of debris therefrom. connector 34 can be of metal, rubber, glass, plastic, ceramic, or the like, conduit 28 can be of plastic or rubber, and head 46 also is preferably of plastic or rubber or both. Other materials can also be used. System 10 is safe, efficient, durable and rapid and simple to use.

FIG. 4

Figure 4:
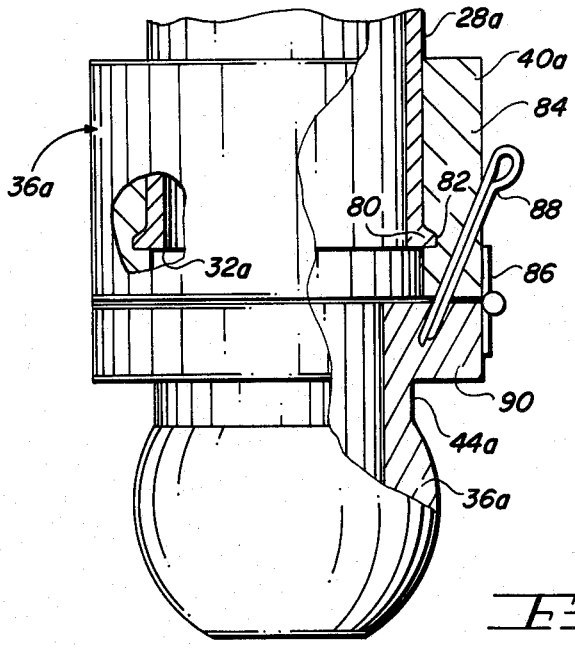

A modified form of the means for connecting the flexible conduit and ball joint connector of the invention is schematically illustrated in FIG. 4. Thus, conduit 28*a* is shown, identical to conduit 28 except that lower end 32*a* thereof has a single peripheral ring 80 which fits into an annular recess 82 in the cup 40*a* of component 36*a*. Connector 34*a* is identical to connector 34, except that cup 40*a* has an openable wall portion 84 hinged at 86 to permit easy insertion of end 32*a* into cup 40*a*. Portion 84 can be locked shut, as shown in FIG. 4, as by a pin 88 running through portion 84 and the adjacent stationary portion 90 of cup 40*a*. This modification can be substituted for that shown in FIGS. 1–3, with comparable results.

Various other modifications, changes, alterations and additions can be made in the improved pool bottom vacuum cleaning system of the present invention, its components and their parameters. All such changes, modifications, alterations and additions as are within the scope of the appended claims form part of the present invention.

What is claimed is:

1. In a pool vacuum cleaning system comprising a vacuum generating device, a weighted vacuum head and a flexible conduit connecting said vacuum generating device to said vacuum head, the improvement comprising:

(a) a universal ball joint connector assembly having its upper portion secured to said conduit and its lower portion connected to said vacuum head, (b) said ball joint connector assembly having means defining a passageway extending therethrough to enable water to pass from said vacuum head, through said passageway to said conduit, (c) whereby movement of said ball joint connector assembly enables the conduit to automatically position itself with respect to said vacuum head so as to minimize bending stresses developed in said conduit while using the pool vacuum cleaning device.

2. The improved pool vacuum cleaning system of claim 1 wherein, (a) said vacuum head is weighted so as to keep it located upon the bottom of a pool, (b) said vacuum head including an upwardly extending stem having means defining a passageway extending therethrough, (c) wherein the lower end of said ball joint connector assembly is connected to said stem.

3. The improved system of claim 2 wherein said ball joint connector assembly includes, (a) a conduit receiving assembly comprising:

(1) an upper portion adapted to releasably retain said flexible conduit, and (2) a ball joint lower portion integral with said upper portion, (b) a stem receiving assembly comprising, (1) a lower portion adapted to receive and retain the stem on said vacuum head, and (2) an upper portion adapted to releasably secure and retain said ball joint lower portion, (c) whereby said ball joint connector assembly can be readily and easily interposed between said conduit and vacuum head.

4. The improved system of claim 3 wherein the lower portion of said stem receiving assembly includes a sleeve bearing a detent to lock said sleeve to said stem and said upper portion of the stem receiving assembly including a smooth curved annular insert, said insert adapted to bear against said ball joint lower portion so as to retain said ball joint lower portion in said upper portion of the stem receiving assembly to allow for universal rotation of said ball joint lower portion with respect to said head.

5. The improved system of claim 4 wherein said insert is disposed in a recess in the inner surface at the upper end of said sleeve and wherein said upper portion of said conduit receiving assembly is spaced above said sleeve by a narrow neck portion to permit free rotation of said vacuum head without impingement of said sleeve and the upper portion of said conduit receiving assembly.

6. The improved system of claim 3 wherein the lower end of said flexible conduit is threadably received in the upper portion of said conduit receiving assembly.

7. The improved system of claim 1 wherein the lower end of said flexible conduit includes retainer means and wherein the upper end of said ball joint connector assembly can be opened to receive and lock in place said retainer means.

8. The improved system of claim 7 wherein said lower end of said flexible conduit includes a retainer ring extending outwardly therefrom, wherein said upper end of said ball joint connector assembly contains a recess on the inner surface thereof for seating said ring, and wherein a portion of said upper end of said ball joint connector assembly is hinged to open to permit insertion and removal of said conduit lower end therein and includes locking means.

9. The improved system of claim 1 wherein said vacuum head has an expanded bottom suction area defined by a depending perimeter and includes metal weights to hold said head at the bottom of a pool, and wherein said device includes a filter and waste disposal means.

10. The improved system of claim 9 wherein said vacuum head is sufficiently flexible and resilient to permit contact with and efficient suctioning in pool corners.

11. The improved system of claim 1 wherein said ball joint connector assembly includes a ball joint component with a means defining central vertical passageway, and an upper cup-shaped end adapted to releasably receive and grip the lower end of said flexible conduit 12. The improved system of claim 11 wherein the lower end of said flexible conduit is threadably received in the upper cup end of said ball joint component.

13. The improved system of claim 11 wherein the lower end of said flexible conduit includes retainer means and wherein the upper end of said ball joint component is openable to receive and lock in said retainer means.

14. The improved system of claim 11 wherein said ball joint connector assembly includes a sleeve bearing a detent adjacent the lower end thereof to lock said sleeve to said head stem and including a smooth curved annular insert adjacent the upper end thereof, said insert bearing against said curved outer ball joint component surface and retaining said ball joint component in said connector assembly for universal rotation of said ball joint component and head.

15. The improved system of claim 11 wherein said insert is disposed in a recess in the inner surface at the upper end of said sleeve and wherein said upper end of said ball joint component is spaced above said sleeve by a narrow neck portion to permit free rotation of said vacuum head without impingement of said sleeve and the upper end of said ball joint component.

16. The improved system of claim 13 wherein said lower end of said flexible conduit includes a retainer ring extending outwardly therefrom, wherein said upper end of said ball joint component contains a recess on the inner surface thereof for seating said ring, and wherein a portion of said upper end of said ball joint component is hinged so as to open to permit insertion and removal of said conduit lower end therein and wherein said upper portion of said upper end includes locking means.

17. The improved system of claim 1 wherein said vacuum head has an expanded bottom suction area defined by a depending perimeter and includes metal weights to hold said head at the bottom of a pool, and wherein said device includes a filter and waste disposal means.

18. The improved system of claim 17 wherein said vacuum head is sufficiently flexible and resilient to permit contact with and efficient suctioning in pool corners.

* * * * *